United States Patent [19]

Beavitt

[11] 3,984,794

[45] Oct. 5, 1976

[54] REED CONTACT UNIT

[75] Inventor: Alan R. Beavitt, Towcester, England

[73] Assignee: Square D Company, Park Ridge, Ill.

[22] Filed: Mar. 10, 1975

[21] Appl. No.: 557,211

[30] Foreign Application Priority Data

Mar. 11, 1974 United Kingdom ..... 10712/74

[52] U.S. Cl. ..... 335/154; 335/196

[51] Int. Cl.[2] ..... H01H 51/06

[58] Field of Search ..... 335/154, 153, 152, 151, 335/196

[56] References Cited

UNITED STATES PATENTS

| | | | |
|---|---|---|---|
| 2,834,848 | 5/1958 | Ellwood | 335/154 |
| 3,665,349 | 5/1972 | Beavitt | 335/154 |

*Primary Examiner*—Harold Broome

*Attorney, Agent, or Firm*—Harold J. Rathbun; James S. Pristelski

[57] ABSTRACT

The reed contact unit comprises a pair of aligned members of magnetizable and electrically conductive material spaced apart endwise from each other. A fillet of non-magnetic electrically conductive material may be inserted between the spaced ends of the members. A flat electrically conductive resilient member supported at its opposite ends carries, at its mid-region, a magnetizable and electrically conductive armature and suspends it over the fillet and the adjacent end portions of the magnetizable members. Upon magnetization of the members, a lower contact surface of the armature engages the ends of the magnetizable members and completes an electric circuit from at least one of the magnetizable members through the resilient member to its support. The magnetizable members and the resilient member are mounted within a sealed enclosure.

16 Claims, 6 Drawing Figures

REED CONTACT UNIT

BACKGROUND OF THE INVENTION

Figure 1:
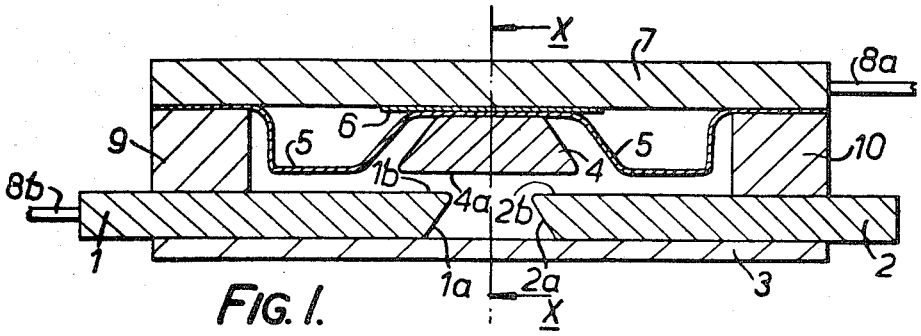

The invention relates to electric reed switches and more particularly to a reed switch having a contact-making magnetic armature suspended from a resilient member over an air gap at the ends of a pair of longitudinally spaced conductive magnetizable members.

The invention is an improved reed switch having similarities to that disclosed in U.S. Pat. No. 3,665,349 which issued on May 23, 1972.

In the switch disclosed in the patent, a pair of longitudinally spaced members of magnetizable material constitute an electrical contact of a switch and a fillet of non-magnetic material is positioned between the adjacent ends of the members. The upper surface of the fillet is positioned below the upper surface of the members. An armature mounted on a cantilever is arranged to engage the end portions of the members upon the creation of a magnetic field thereby to complete a circuit directly between the members and the armature there being no interposition of a more suitable contact material.

SUMMARY OF THE INVENTION

The invention provides a reed contact unit which includes a pair of aligned elongated members of a magnetizable and electrically conductive material spaced apart endwise from each other, the adjacent end portions of the elongated members constituting a stationary contact for the contact unit; a resilient member mounted so as to be electrically independent of the elongated members; a magnetizable armature secured to the resilient member and overlying the said adjacent end portions, the resilient member being arranged so that a symmetrical contact gap is provided between the armature and the stationary contact and so that armature movement is in a plane normal to the stationary contact, attraction of the armature to the elongated members upon magnetization of the members causing the armature to bridge the space between the elongated members and complete an electrical circuit including at least one of the elongated members. The elongated members and the resilient member are preferably symmetrically disposed relative to the armature.

In carrying out the invention, the adjacent end portions of the elongated members may be provided with longitudinally flat contact surfaces, and the armature may be provided with a corresponding longitudinally and substantially flat contact surface, the contact surface of the armature being movable into and out of bridging contact with the contact surfaces of the elongated members.

In one arrangement for the reed contact unit according to the invention, each of the elongated members may be of rectangular cross-section and the adjacent ends of the elongated members may be angled away from the respective contact surfaces thereof so that the space between the elongated members is a minimum at the surfaces.

In another arrangement for the reed contact unit according to the invention, a fillet of a non-magnetic electrically conductive material is inserted between the spaced ends of the elongated members so that the surface of the fillet is co-planar with the stationary contact surfaces of the elongated members thereby providing a continuous contact surface for the stationary contact.

In another arrangement for the reed contact unit according to the invention, the contact surfaces of the armature and the stationary contact may each be either coated with a layer of an electrical contact material or have a disc of an electrical contact material secured thereto. Conveniently, the contact discs may each be located and secured within a recess in the associated contact surface.

In a further arrangement for the reed contact unit according to the invention, a stop member is included for minimizing armature oscillations after the electric circuit is broken. Conveniently, the stop member is provided by a wall of an enclosure of the contact unit.

In a preferred arrangement, the reed contact unit according to the invention includes an enclosure wherein at least part of one wall thereof is formed by the elongated members, wherein another wall opposite to the said one wall is formed by a stop member for the armature, wherein the end walls thereof are of a non-magnetic electrically insulating material and are each situated between said another wall and a separate one of the elongated members, the length of the end walls determining the size of the contact gap between the armature and the elongated members, and wherein the side walls thereof enclose the space defined by the other walls. Conveniently, the side walls and the end walls are formed as a single plastic molding. The enclosure may be sealed with a coating of a plastic encapsulating medium.

Figure 3:
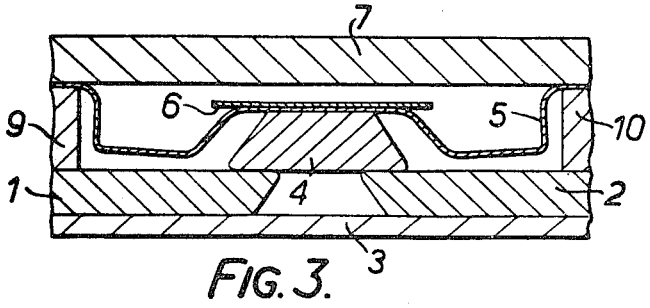
Figure 2:
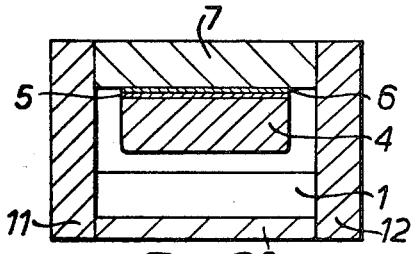
Figure 4:
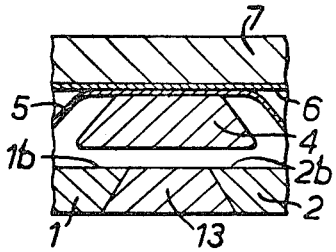
Figure 5:
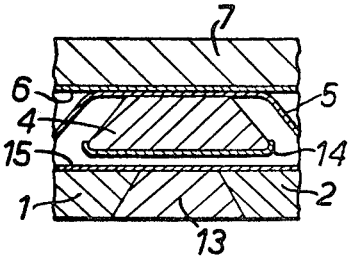
Figure 6:
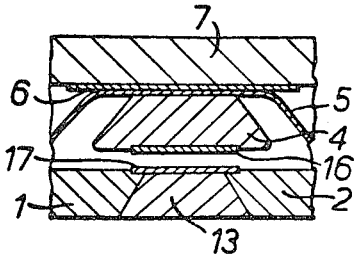

The foregoing and other features according to the invention will be better understood from the following description with reference to the drawings in which:

FIG. 1 diagrammatically illustrates in a cross-sectional side elevation of one arrangement for the reed contact unit according to the invention, FIG. 2 diagrammatically illustrates the reed contact unit arrangement of FIG. 1 in a cross-sectional elevation on the line X—X, FIG. 3 diagrammatically illustrates the reed contact unit arrangement of FIG. 1 when operated, and FIGS. 4 to 6 diagrammatically illustrate, in part, cross-sectional side elevations of further arrangements for the reed contact unit according to the invention.

The reed contact unit diagrammatically illustrated in FIGS. 1 and 2 of the drawings includes two aligned elongated members 1 and 2 which are of a magnetizable and electrically conductive material and which are of rectangular cross-section. The members 1 and 2, which are preferably of iron, are spaced apart endwise from each other and the adjacent ends 1*a* and 2*a* thereof are preferably chamfered in order to reduce the flux leakage therebetween, the chamfering being such that the ends 1*a* and 2*a* are angled away from the surfaces 1*b* and 2*b* respectively of the members 1 and 2 so that the width between them is at a minimum at the surfaces 1*b* and 2*b*. The adjacent end portions of the members 1 and 2 form a stationary contact for the contact unit.

The members 1 and 2 are secured to a non-magnetic and electrically conducting backing plate 3 in order to maintain their alignment and spaced relationship, and the members 1 and 2 in association with the plate 3 form one wall of an enclosure for the reed contact unit.

A magnetizable armature 4, typically of iron and conveniently stamped out of the iron strip from which the iron members 1 and 2 are formed, is welded or otherwise secured to a resilient member 5 and a weld relief backing member 6. The armature 4, which is chamfered in order to reduce the effective mass and to facilitate the provision of a compact structure for the contact unit, is arranged so that it overlies, and is spaced apart from, the stationary contact. The resilient member 5, which is preferably provided by a one-piece spring, is shaped so that a symmetrical contact gap is provided between the armature 4 and the stationary contact and so that armature movement is in a plane normal to the stationary contact surfaces.

The resilient member 5 and the members 1 and 2 are preferably symmetrically disposed relative to the armature 4.

The free ends of the resilient member 5 are secured to a nonmagnetic and electrically conductive member 7 which forms another wall for the enclosure of the contact unit and which preferably acts as a backstop for the armature 4, i.e. is used, in a manner to be subsequently outlined, to minimize armature oscillations. The members 5 and 7 must be in electrical contact.

It should be noted that the contact gap between the armature and the stationary contact must be such that when a longitudinal magnetic field (not illustrated) is brought into the vicinity of the members 1 and 2, they become polarized and cause the armature 4 to be attracted towards them so that the armature 4 makes, as is illustrated in FIG. 3 of the drawings, bridging contact with the members 1 and 2. When the magnetic field is removed, the resilience of the member 5 causes the armature to be moved away from the stationary contact and the electric circuit to be broken. As a result of this operation, the armature 4 is caused to oscillate but the backstop provided by the member 7 is adapted to minimize the oscillations to an acceptable level.

If desired, the member 7 can be spaced apart from the backing member 6 and the backstop provided by a separate member (not illustrated) situated in the space between the members 6 and 7 and attached to the member 7.

The adjacent end portions of the members 1 and 2 have longitudinally flat contact surfaces 1*b* and 2*b*, and the armature 4 has a corresponding longitudinally and substantially flat contact surface 4*a*, the edges of the contact surface 4*a* being profiled i.e. rounded, in order to avoid concentrating contact material erosion along one edge of the armature. The resilient member 5 is such that the contact surfaces are always parallel to each other.

End walls 9 and 10 for the enclosure of the contact unit are of a plastic material and are respectively secured, using any suitable adhesive, to the surfaces 1*b* and 2*b* of the members 1 and 2 and to the ends of the resilient member 5. The length of the end walls 9 and 10 determines the size of the contact gap between the armature 4 and the stationary contact.

Side walls 11 and 12 for the enclosure of the contact unit are of a plastic material and enclose the space defined by the other walls of the enclosure. In a preferred arrangement, the end walls 9 and 10, and the side walls 11 and 12 can be formed as a single plastic molding.

The members 1 and 2 extend from the respective ends of the enclosure which can, if desired, be hermetically sealed by applying thereto a coating of a plastic encapsulating medium. In practice, the sealing may be effected in an atmosphere of dry air using a conventional dip coating technique.

Electric terminal leads 8*a* and 8*b* for the contact unit are respectively attached to the member 7 and the member 1.

Since the resilient member 5 is in contact with the armature 4 and the member 7, the latter are electrically connected, and the effect of the application of the magnetic field is to cause an electric connection to be made between the members 1 and 2 and the armature 4 and thus between the electric terminal leads 8*a* and 8*b*. Thus the electric circuit is formed by the member 7, the resilient member 5, the armature 4 and the member 1 while the magnetic circuit is formed by the member 1, the armature 4 and the member 2.

As is diagrammatically illustrated in FIG. 4 of the drawings, a fillet 13 of a non-magnetic electrically conductive material such as copper may be inserted between the ends 1*a* and 2*a* of the members 1 and 2. The surface of the fillet 13 is made co-planar with the surfaces 1*b* and 2*b* of the members 1 and 2 in order to provide a stationary contact having a continuous and relatively large contact surface area. With this arrangement, the backing plate 3 can be dispensed with and the side wall of the enclosure of the contact unit would, therefore, be formed by the members 1 and 2 and the fillet 13.

The fillet 13 provides a continuous and relatively large contact surface area for the stationary contact and thereby increases the effective contact area for the armature 4 and also increases contact life because of the increase in the contact area available for erosion.

In order to reduce contact resistance and the possibility of welding on contact closure, the contact surfaces of the armature 4 and the stationary contact can, as is illustrated in FIG. 5 of the drawings, be respectively coated with layers 14 and 15 of a contact material such as tungsten. The contact material thicknesses that can be used for the layers 14 and 15 are limited by magnetic considerations but the use of the fillet 13 ensures that a relatively large area of contact material is available for erosion, and, therefore, the contact life is increased in comparison to known devices.

In a further arrangement for the reed contact unit according to the invention, the layers 14 and 15 of FIG. 5 can, as is illustrated in FIG. 6 of the drawings, be respectively replaced by discs 16 and 17 of a contact material such as tungsten. The discs 16 and 17 are each preferably located and secured within a recess in the associated contact surface. The area of the respective contact surfaces of the members 1 and 2 and the armature 4 not covered by the discs 16 and 17 must be sufficient to achieve the desired magnetic properties for the contact unit i.e. the magnetic circuit between the member 1, the armature 4 and the member 2 must be such that efficient operation of the contact unit can be achieved. Also, the depth of each of the recesses for the discs 16 and 17 and the disc thicknesses must be selected so that the resulting air gaps between the armature 4 and the members 1 and 2 do not adversely affect the reluctance of the magnetic circuit of the contact unit.

It should be noted that the contact material used for the layers 14 and 15 and the discs 16 and 17 can be of any material such as silver/cadmium oxide or tungsten that is suitable for use in air.

The reed contact unit arrangement of FIGS. 1 and 2 which is ideally suited for handling currents of the order of 5 amps at 240 volts a.c., can be modified for use in low voltage/high current applications by making the backing plate 3 non-conductive and by connecting the electrical terminal lead 8*a* to the member 2 instead of the member 7. Thus, with this modified arrangement, the electric circuit is formed by the member 1, the armature 4 and the member 2 and is thereby capable of handling high currents, for example, a make current of 200 amps and a break current of 20 amps at 12 volts.

The backing plate 3 and side walls 11 and 12 of the low voltage/high current reed contact unit can be omitted in those applications where a totally enclosed unit is not required. With this arrangement it is necessary to ensure that the members 1 and 2 are rigidly secured to the member 7 in order to maintain their alignment and spaced relationship.

As with the other reed contact units, the contact surfaces 1*b* and 2*b* of the members 1 and 2 and the armature 4 of the low voltage/high current reed contact unit and the reed contact unit arrangement of FIGS. 1 and 2 can, in order to reduce contact resistance and the possibility of welding on contact closure, each be coated with a layer of an electrical contact material or have a disc of an electrical contact material secured thereto, preferably within a recess. The contact material can be of any material that is suitable for use in air, for example, silver/cadmium oxide or tungsten.

It can, therefore, be seen from the foregoing that the use of a fillet 13 increases the area of the contact surface that is available for erosion and therefore increases contact life and that the construction of the enclosure of the contact unit is inexpensive and relatively easy to produce in comparison to known reed contact units because expensive glass-to-metal seals are avoided.

Also, in the unencapsulated state, the reed contact unit according to the invention is ideally suited for use in applications where a high standard of hermeticity is not required.

A further advantage of the reed contact unit according to the invention is that unlike a conventional reed switch wherein the contact blades conduct flux to the contact region as well as providing for electrical connection and retractile force, the construction of the reed contact unit according to the present invention is such that the retractile force for the armature 4 and the electrical connection are provided for by the resilient member 5 which does not need to conduct flux. This has the advantage that a good spring material can be used for the member 5.

Another advantage of the reed contact unit according to the invention is that the armature 4, where most of the effective mass of the contact unit is concentrated, only needs to conduct flux across the non-magnetic gap between the members 1 and 2, therefore, the ratio of operating force to effective mass is much larger than that of a conventional reed switch. This advantage allows shorter operating times to be used, results in shorter contact bounce periods and improves the shock and vibration resistance of the contact unit.

Other advantages of the reed contact unit according to the invention are that it is structurally very robust and reasonably inexpensive to produce.

We claim:

1. A reed contact unit comprising a pair of aligned elongated members each having a co-planar surface of a magnetizable and electrically conductive material spaced apart endwise from each other; a fillet of a non-magnetic electrically conductive material inserted between the space ends of the elongated members with a surface of the fillet co-planar with the co-planar surfaces of the elongated members to produce a substantially continuous contact surface with at least one of the adjacent end portions of the co-planar surfaces of the elongated members and the co-planar surface of the fillet constituting a stationary contact for the contact unit; a resilient member mounted to be electrically independent of the elongated members; a magnetizable armature secured to the resilient member and positioned to overlie the fillet and at least one of the adjacent end portions to create a contact gap between the armature and the stationary contact and to move in a direction substantially normal to the co-planar surfaces of the stationary contact upon attraction of the armature to the elongated members upon magnetization of the members to complete an electric circuit including at least one of the elongated members, the armature, and the fillet.

2. A reed contact unit as claimed in claim 1 wherein the elongated members are of rectangular cross-section.

3. A reed contact unit as claimed in claim 2 wherein the adjacent ends of the elongated members are angled away from the respective co-planar surfaces thereof so that the space between the elongated members is a minimum at the co-planar surfaces and wherein the fillet surfaces are angled away from the co-planar surface of the fillet to substantially fill the space between the adjacent ends of the elongated members.

4. A reed contact unit as claimed in claim 1 wherein said electric circuit is through the resilient member to the elongated members.

5. A reed contact unit as claimed in claim 1 the said electric circuit is constituted by the armature and the elongated members.

6. A reed contact unit as claimed in claim 1 wherein the fillet is of copper.

7. A reed contact unit as claimed in claim 1 wherein the contact surfaces of the armature and the stationary contact are each coated with a layer of an electrical contact material.

8. A reed contact unit as claimed in claim 1 wherein the contact surfaces of the armature and the stationary contact each have a disc of an electrical contact material secured thereto.

9. A reed contact unit as claimed in claim 8 wherein the contact discs are each located and secured within a recess in the associated contact surface.

10. A reed contact unit as claimed in claim 7 wherein the electrical contact material is either tungsten or silver/cadmium oxide.

11. A reed contact unit as claimed in claim 1 also comprising a stop member positioned to limit movement of the armature to a selected distance away from the stationary contact to thereby minimize oscillations of the armature after the electric circuit is broken.

12. A reed contact unit as claimed in claim 11 wherein the stop member is provided by a wall of an enclosure of the contact unit.

13. A reed contact unit as claimed in claim 1 which also includes an enclosure wherein at least part of one wall thereof is formed by the elongated members, wherein another wall opposite to said one wall is formed by a stop member for the armature, wherein the end walls thereof are of a non-magnetic electrically insulating material and are each situated between said another wall and a separate one of the elongated members, the length of the end walls determining the size of the contact gap between the armature and the elongated members, and wherein the side walls thereof enclose the space defined by the other walls.

14. A reed contact unit as claimed in claim 13 wherein the side walls and the end walls of the enclosure are formed as a single plastic molding.

15. A reed contact unit as claimed in claim 13 wherein the enclosure is sealed with a coating of a plastic encapsulating medium.

16. A reed contact unit as claimed in claim 1 wherein the resilient member is provided by a one-piece spring.

* * * * *